US006887105B2

(12) United States Patent
Knighten et al.

(10) Patent No.: US 6,887,105 B2
(45) Date of Patent: May 3, 2005

(54) PROVIDING SHIELDS TO REDUCE ELECTROMAGNETIC INTERFERENCE FROM CONNECTORS

(75) Inventors: James L. Knighten, Poway, CA (US); Arthur R. Alexander, Valley Center, CA (US)

(73) Assignee: NCR Corporation, Dayton, OH (US)

( * ) Notice: Subject to any disclaimer, the term of this patent is extended or adjusted under 35 U.S.C. 154(b) by 286 days.

(21) Appl. No.: 09/881,464

(22) Filed: Jun. 14, 2001

(65) Prior Publication Data

US 2003/0024717 A1 Feb. 6, 2003

(51) Int. Cl.[7] ..... H01R 9/03
(52) U.S. Cl. ..... 439/610; 439/939
(58) Field of Search ..... 439/610, 939, 439/607, 578, 374, 394

(56) References Cited

U.S. PATENT DOCUMENTS

| | | | | | |
|---|---|---|---|---|---|
| 3,154,362 | A | * | 10/1964 | Blonder et al. | 439/394 |
| 3,391,381 | A | * | 7/1968 | Livingston | 439/610 |
| 3,775,732 | A | | 11/1973 | Frogner | |
| 4,160,572 | A | | 7/1979 | Adelberger et al. | |
| 4,401,355 | A | * | 8/1983 | Young | |
| 4,529,257 | A | * | 7/1985 | Goodman et al. | 439/271 |
| 4,732,568 | A | * | 3/1988 | Hall | 439/676 |
| 4,830,629 | A | * | 5/1989 | Yoshimura | 439/610 |
| 4,887,971 | A | * | 12/1989 | Reuss | 439/610 |
| 4,934,960 | A | * | 6/1990 | Capp et al. | 439/620 |
| 4,990,094 | A | * | 2/1991 | Chandler et al. | 439/108 |
| 5,207,597 | A | * | 5/1993 | Kline et al. | 439/607 |
| 5,338,211 | A | * | 8/1994 | Kodama et al. | 439/314 |
| 5,641,294 | A | * | 6/1997 | Beard | 439/247 |
| 5,902,151 | A | * | 5/1999 | Havener et al. | 439/607 |
| 6,010,365 | A | * | 1/2000 | Wu et al. | 439/607 |
| 6,062,893 | A | * | 5/2000 | Miskin et al. | 439/374 |
| 6,206,731 | B1 | * | 3/2001 | Kuo | 439/610 |
| 6,215,666 | B1 | * | 4/2001 | Hileman et al. | 361/752 |
| 6,482,017 | B1 | * | 11/2002 | Van Doorn | 439/89 |

FOREIGN PATENT DOCUMENTS

DE 9215124 10/1994

OTHER PUBLICATIONS

U.S. Appl. No. 10/161,023, filed May 31, 2002.
U.S. Appl. No. 10/293,067, filed Nov. 13, 2002.

(Continued)

*Primary Examiner*—Neil Abrams
(74) *Attorney, Agent, or Firm*—Trop, Pruner & Hu, P.C.

(57) ABSTRACT

A method and apparatus to provide a shield assembly for a connector, with the shield assembly having a cover to enclose the connector and a neck portion adapted to surround an outer surface of a portion of the cable. An inner surface of the neck portion makes contact with the outer surface of the cable. When the cable carries a high frequency signal, a capacitive impedance is provided between the neck portion and an outer shield of the cable to reduce electromagnetic signal leakage. Alternatively, the neck portion can make electrical contact with the cable shield, either by use of elements protruding from the inner surface of the neck portion or by removing an insulating jacket of the cable.

35 Claims, 6 Drawing Sheets

OTHER PUBLICATIONS

InfiniBand[SM] Trade Association, InfiniBand™ Architecture Release 1.0 vol. 2—Physical Specifications, "Copper Cable," pp. 155–156 and 169–170 (Oct. 2000).

Laird Technologies, "All Purpose Gaskets," dated at least as early as Mar. 21, 2001 and printed from http://www.instrumentspecialties.com/scripts/cgiip.exe/WService=wsCatalog/pg66.r?webic., 2 pages.

Tecknit, A. Wire Mesh, "Custom Strips, Wire Mesh Over Elastomer Core," pp. A–3–A–4 (dated before the filing date of the present application).

Tecknit, B. Metal Fibers and Screens, "Duolastic™ Wire Screen Impregnated with Elastomer," pp. B–1–B–2 (dated before the filing date of the present application).

Tecknit, B. Metal Fibers and Screens, "Conmax® Nickel Fiber–Filled Silicone Elastomer," pp. B–7–B–8 (dated before the filing date of the present application).

Tecknit, C. Oriented Wires, "Elastomet® Oriented Wires in Solid Silicone Rubber," pp. C–1–C–2 (dated before the filing date of the present application).

Tecknit, D. Conductive Elastomers, "Consil®—II, Molded Silver–Filled Silicone Elastomer," pp. D–11–D–12 (dated before the filing date of the present application).

Tecknit, H. Shielding Components, "EMI Connector Gaskets, EMI Flange Seals for Electrical Connectors," p. H–5 (dated before the filing date of the present application).

Electromagnetic Compatibility Handbook, "Connectors," pp. 246–247 (dated before the filing date of the present application).

Photograph of D–shell Connectors, 1 page (dated before the filing date of the present application).

* cited by examiner

PROVIDING SHIELDS TO REDUCE ELECTROMAGNETIC INTERFERENCE FROM CONNECTORS

BACKGROUND

Interconnect links (in the form of cables and so forth) are used to couple various types of electronic devices, such as computer systems, peripheral devices of the computer systems, storage systems, servers, routers, and other devices. Modem electronic devices operate at high frequencies, with signals communicated over the cables to transfer data and control information. To reduce radiated emissions, cables are typically shielded with an outer shield. In addition, connectors that connect the cables to respective devices are also typically shielded to reduce radiated emissions. A primary concern of radiated emissions is the potential for electromagnetic interference (EMI).

A cable includes one or more wires that terminate at corresponding contacts (male or female) in a connector. The connector typically includes a housing or shell to enclose the contacts. The connector contacts are designed to mate with corresponding contacts (female or male) in a port provided in the outer chassis of an electronic device. Typically, the connector shell is electrically contacted to the outer shield of the cable. Also, once the connector is mated with the port, the connector is also electrically contacted to the chassis of the electronic device. As a result, a substantially continuous shield is provided from the chassis of one device or system to the chassis of another device or system, which helps reduce EMI.

However, shield designs for connectors that were adequate for lower operating speeds may no longer be acceptable for higher speed operation. At higher speeds, the rise and fall times of signals are decreased, which leads to increased radiated emissions at higher frequencies. As a result, connectors may become "leaky." The problem of radiated emissions from "leaky" shields of connectors is exacerbated when a large number of such connectors are placed in close proximity to each other, which sometimes occurs in systems having large numbers of nodes and devices. Thus, as operating speeds continue to increase and the density of electronic equipment and corresponding connectors increases, EMI protection provided by conventional connector designs may not be adequate.

SUMMARY

In general, an improved shield assembly to reduce electromagnetic leakage and interference is provided for connectors. For example, a shield assembly for use with a connector coupled to a port of a chassis includes a shroud adapted to enclose the connector. The shroud has an electrically conductive first end to electrically contact the chassis. The shroud also has a cable engagement body with an inner opening to receive a cable extending from the connector. The cable engagement body has an inner surface in contact with an outer surface of the cable.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1A:
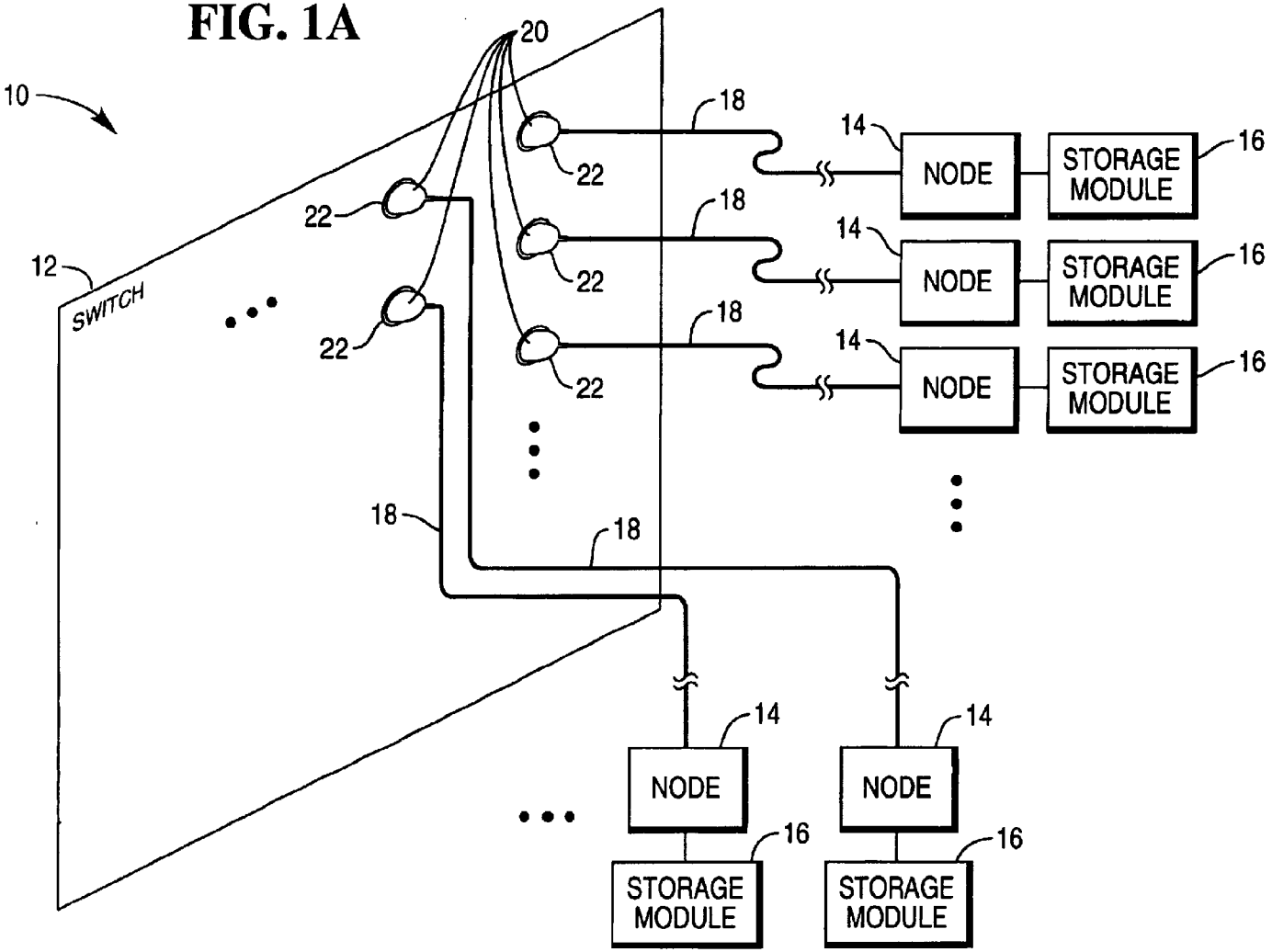
FIGS. 1A–1C are block diagrams of example systems in which connector assemblies according to some embodiments are used.
Figure 1B:
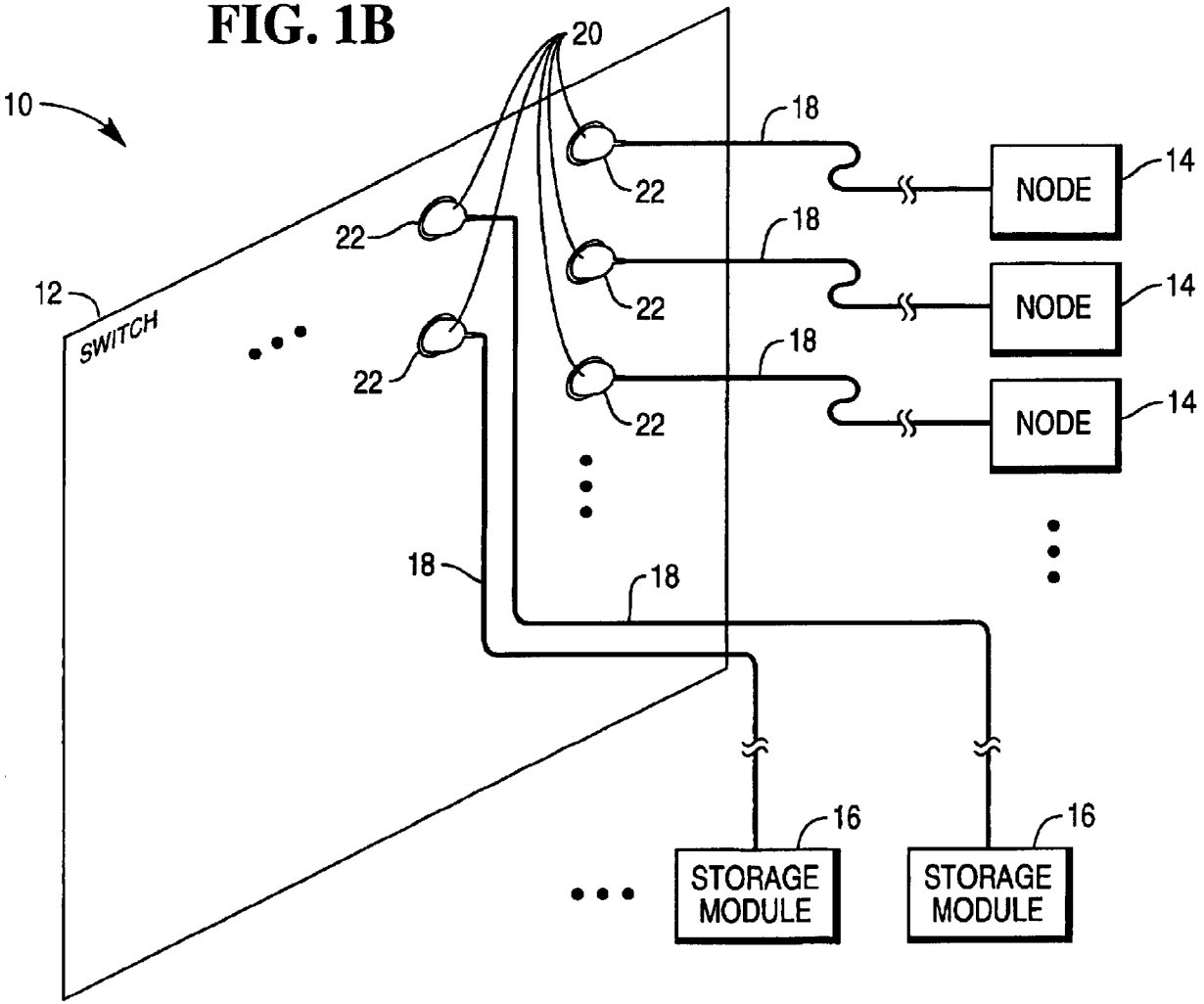
Figure 1C:
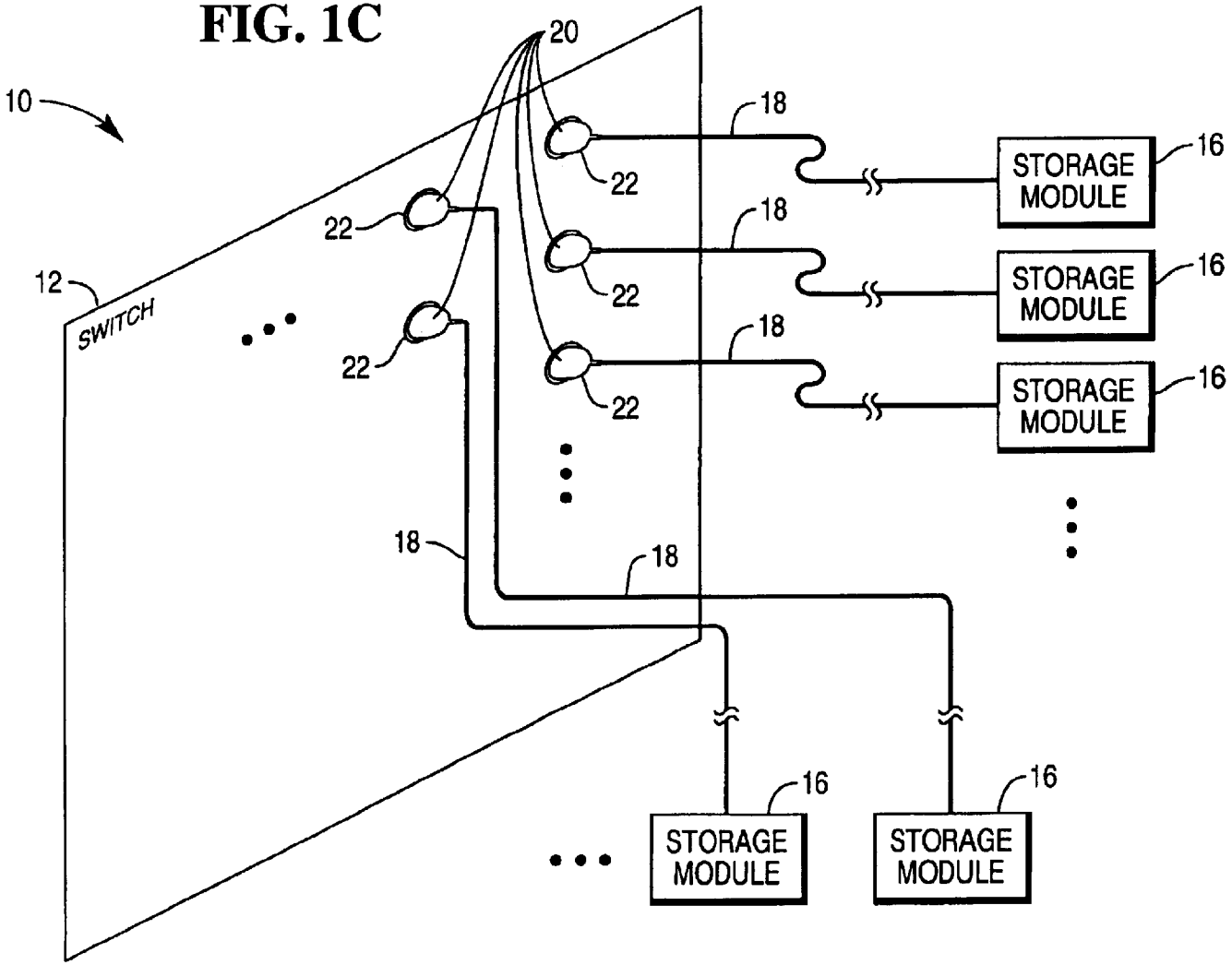

FIG. 1A shows an example system 10 that includes a switch 12 interconnected to a plurality of nodes 14 by cables 18. Each node 14 is connected to a corresponding storage module 16. One end of each cable 18 is attached to a connector assembly 20 that attaches to a corresponding port 22 on the housing or chassis of the switch 12. In FIG. 1A, the connector assembly 20 is shown as connecting one end of each of the cables 18 to the switch 12. The same connector assembly 20 can be used to connect the other end of each cable 18 to a respective node 14. In an alternative embodiment, as shown in FIG. 1B, instead of nodes being connected directly to storage modules, both nodes 14 and storage modules 16 are coupled through the switch 12. In yet another embodiment, as shown in FIG. 1C, storage modules 16 but not nodes 14 are coupled by the cables 18 to the switch 12.

The example system 10 in one embodiment is a database system, such as a TERADATA® database system from NCR Corporation. In other embodiments, other types of systems can also use the connector assemblies 20. Each node 14 manages a portion of the storage space available in the storage modules 16. The plurality of nodes 14 make up a massively parallel processing system that provides a high performance database system in which relatively large amounts (e.g., terabytes) of data can be efficiently and quickly processed. Thus, in the example of FIG. 1A or 1B, the large number of connections to the switch 16 results in a relatively high density of connector assemblies 20 in relative close proximity to each other. Also, the operating frequency of signals carried by the cables 18 is relatively high (e.g., in the gigahertz range). With a high operating frequency and high density of the connector assemblies 20, the aggregate effect of any electromagnetic signal leakage is increased.

To decrease leakage of electromagnetic signals, the connector assembly 20 has an outer shroud or shield that encloses a connector and a portion of a cable. By capturing leakage from the connector assembly 20, electromagnetic interference (EMI) is reduced.

Figure 2:
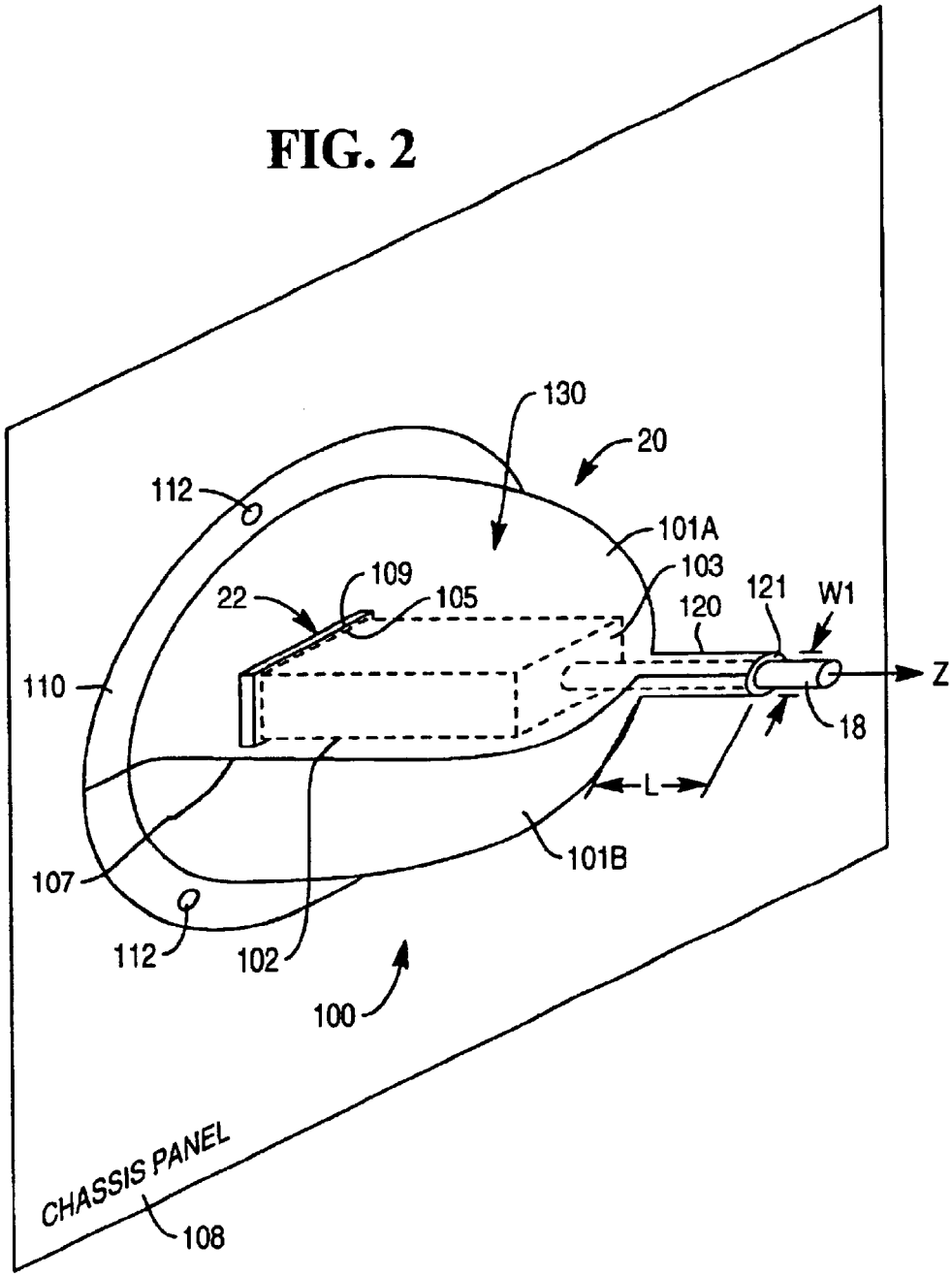
FIG. 2 is a perspective view of a connector assembly having a shield in accordance with one embodiment.

FIG. 2 shows the connector assembly 20 in greater detail. The connector assembly 20 includes an outer shroud 100, which in one embodiment is formed of a metallic material, e.g., aluminum, copper, steel, conductively coated plastic alloys used in die casting, and so forth. Alternatively, the shroud 100 can be formed of any other electrically conductive material. The shroud 100 fully encloses a connector 102, which itself may be shielded (although not required for purposes of the present invention). However, the connector 102 is a "leaky" connector; that is, "unacceptable" electromagnetic signal leakage occurs from the connector 102. Whether an amount of electromagnetic signal leakage from the connector 102 is "unacceptable" depends on the application in which the connector 102 is used as well as on governmental regulatory requirements. For example, a certain level of leakage is acceptable if only a few connectors are in close proximity with each other. However, the same level of leakage may not be acceptable if there is a higher density of the connectors 102. Also, the operating frequency affects the amount of leakage, with leakage more likely at higher operating frequencies. The shroud 100 acts as an EMI shield for any electromagnetic signal leakage from the leaky connector 102.

In the illustrated embodiment, the shroud 100 is generally dome-shaped and defines a chamber 130 in which the connector 102 is contained. In other embodiments, the shroud 100 can have any other shape so long as the shroud 100 is shaped to provide the chamber 130 to enclose or cover the connector 102. Examples of other shapes include rectangular, cylindrical, and so forth. Also, as an alternative, the shroud can have a cross-section shaped as a closed polygon.

In one embodiment, a neck portion 120 extends from the shroud 100. The neck portion 120 defines an opening (or bore) 121 to receive the cable 18 that extends from one end 103 of the connector 102. The opening or bore 121 can have any number of cross-sectional shapes, including generally circular, oval, rectangular, square, or another shape that defines a closed polygon. The neck portion 120 is generally cylindrical in shape to correspond to the shape of the cable 18. In other embodiments, the neck portion 120 can have other shapes.

In the illustrated embodiment, the neck portion 120 is integrally formed with the shroud 100. Alternatively, the neck portion 120 is a separate member from the shroud 100, with the neck portion 120 attached or bonded to the shroud 100. The neck portion 120 is also formed of an electrically conductive material.

The bore 121 defined by the neck portion 120 has a width (represented as W1) that is less than a width of the chamber 130 that encloses the connector 102. In the following discussion, it is assumed that the bore 121 is generally cylindrical in shape—as a result, reference is made to the diameter of the bore 121. However, it should be understood that diameter is a special case of the width W1. Cables can have oval, rectangular, or other cross sections that form closed polygons in other examples.

The diameter of the bore 121 is selected to be substantially the same as a diameter of the cable 18 (with the diameter of the bore 121 slightly larger than the diameter of the cable 18), so that an inner surface of the neck portion 120 is in contact or close proximity with an outer surface of the cable 18. The neck portion 120 has a length L along the longitudinal axis, indicated generally as axis Z, of the shroud 100. As further explained below, bringing the inner surface of the neck portion 120 into close proximity or contact with an electrically conductive shield of the cable 18 enables a capacitive impedance to be present between the neck portion 120 and the cable shield when electromagnetic signals are being communicated in the cable 18. The impedance between neck portion and cable shield is based on the capacitance between the neck portion 120 and the cable shield.

FIG. 2 shows the neck portion 120 as having a reduced outer width (as compared to the outer width of the shroud 100). In another embodiment, the shroud 100 and neck portion 120 can be formed from a housing (e.g., a cylindrical housing) that has a consistent outer width, with the housing defining the chamber 130 and the bore 121 (which has a width that is less than that of the chamber 130). More generally, the portion of a member (which can be part of the shroud 100) that defines the bore 121 and that surrounds an outer surface of the cable 18 is referred to as a "cable engagement body." The cable engagement body can have a large variety of geometries.

The shroud 100 in one embodiment is formed of two pieces 101A and 101B, with the two pieces 101A, 101B mated together to cover the connector 102. A seam 107 indicates the edge at which the two shroud pieces 101A, 101B are mated. Forming the shroud 100 out of two pieces 101A, 101B makes it convenient to enclose the connector 102 and cable 18. To prevent slippage of the two pieces 101A, 101B once mated, one piece can be formed with a first engagement profile while another piece formed with a mating profile (e.g., tongue and groove profiles), with the first and second engagement profiles adapted to engage each other. To ensure good electrical connection between the pieces 101A, 101B, a conductive treatment can be used (e.g., EMI gaskets, conductive films or paint, and so forth).

One end 103 of the connector 102 is attached to the cable 18. The other end 105 of the connector 102 connects to a structure 109 defining the port 22 located on a chassis panel 108 of the switch 12. The chassis panel 108 can be part of the chassis of another type of device in another example, such as when a node 14 is connected directly to a storage module 16.

In the embodiment shown in FIG. 2, a flange 110 is located at the end of the shroud 100 proximal the chassis panel 108. In another embodiment, the flange 110 is not provided. As shown in FIG. 2, attachment elements 112 are used to connect the flange 110 to the chassis panel 108. Examples of the attachment elements 112 include screws, bolts, and the like.

Figure 3:
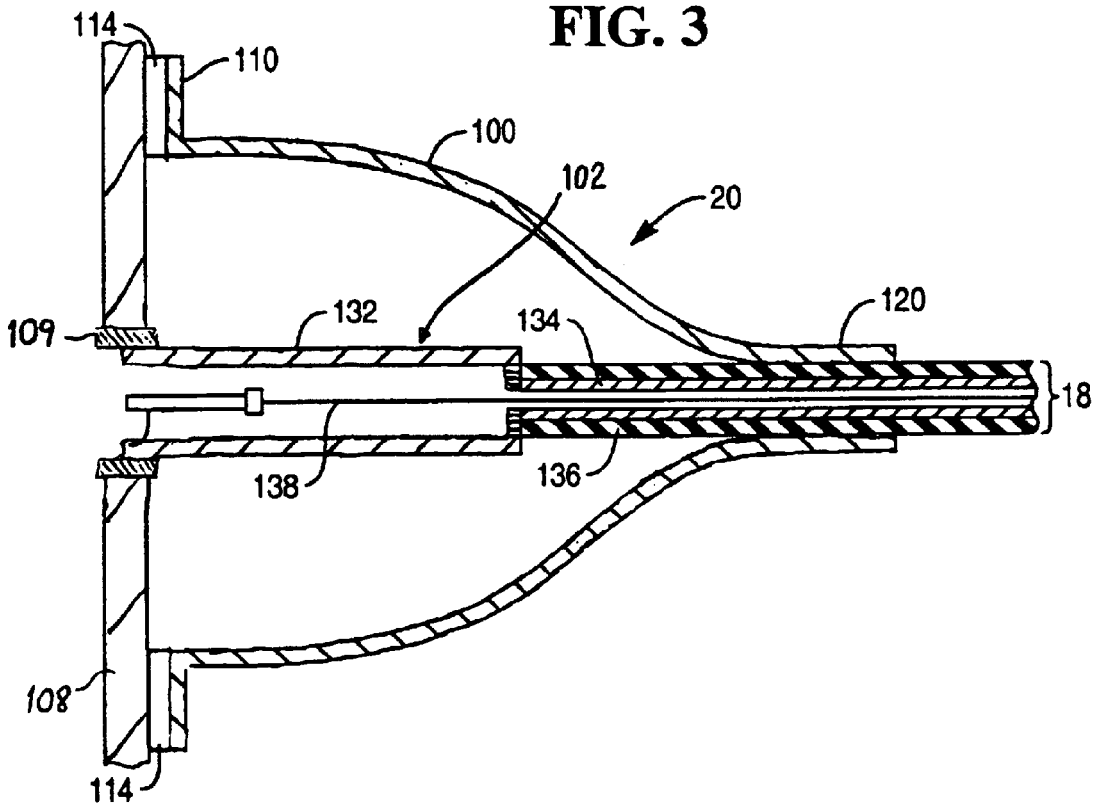
FIG. 3 is a longitudinal sectional view of the connector assembly of FIG. 2.

As shown in FIG. 3, an EMI gasket 114 is optionally provided between the chassis panel 108 and the flange 110 of the shroud 100. The EMI gasket 114 is formed of an electrically conductive material that enhances the electrical contact of the shroud 100 to the chassis 108 and reduces leakage of electromagnetic energy at the contact edge between the shroud 100 and chassis panel 108. Examples of the materials that are used to form the gasket 114 include beryllium copper, conductive elastomer, wire mesh, and so forth. Alternatively, instead of being a separate piece, the EMI gasket 114 is an electrically conductive coating on either the chassis panel 108 or the flange 110 of the shroud 100.

The connector 102 has a housing 132 that, if formed of an electrically conductive material, is adapted to make electrical contact with the port structure 109 so that electrical communication is enabled between the chassis panel 108 and the connector housing 132. In one embodiment, the connector housing 132 is a D-shaped shell to provide a D-shell connector. In an alternative embodiment, the connector 102 is adapted to be mateable with a cable port defined according to the Infiniband™ standard, as described in Infiniband™ Architecture Release 1.0, Volume 2, Physical Specifications, dated October 2000. Other types of connectors can be used in other embodiments such as circular connectors, snap-in connectors, and so forth. In yet another embodiment, the connector can be according to the Fibre Channel Standard provided by the American National Standards Institute (ANSI).

In one embodiment, the connector housing 132 is also electrically contacted to a shield 134 of the cable, which is inside an outer jacket 136 of the cable 18. One or more electrical conductors 138 extend inside the cable 18. The electrical conductors 138 terminate at one or more corresponding contacts 140. In FIG. 3, a male contact 140 is shown.

Effectively, the shroud 100 (including the cable engagement body 120) provides a metallic Faraday cage shield that is constructed to make electrical contact with the chassis panel 108 and to make contact to the cable shield 134 through a capacitive connection. In other embodiments, instead of a capacitive connection, a direct electrical connection can be provided between the cable engagement body 120 and the cable shield 134. The cage fully encloses the leaky connector 102 by electrically contacting the chassis panel 108 and forming the connection (capacitive or electrical) with the cable shield 134. This provides an effective EMI shield for any electromagnetic signal leaking from the connector 102. One benefit of the approach shown in FIGS. 2 and 3 is that the connector 102 and cable 18 do not need to be modified (in accordance with one embodiment) to provide the enhanced EMI shield. As a result, industry standard cables and connectors can be used, which helps reduce costs and increases the availability of parts. Of course, if desired, the connector and cable design can be modified in other embodiments.

Figure 4:
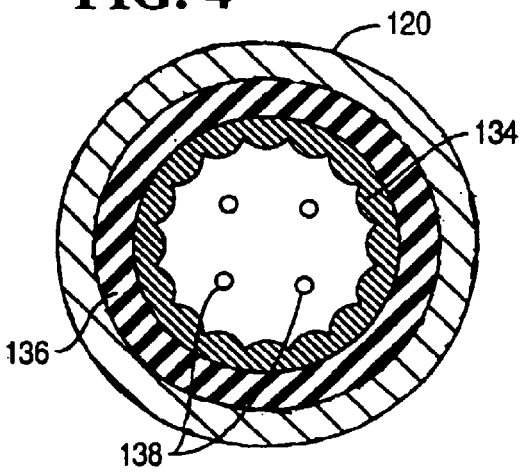
FIG. 4 is a cross-sectional view of a neck portion of the shield of FIG. 2 and a cable arranged inside the neck portion.
Figure 5:
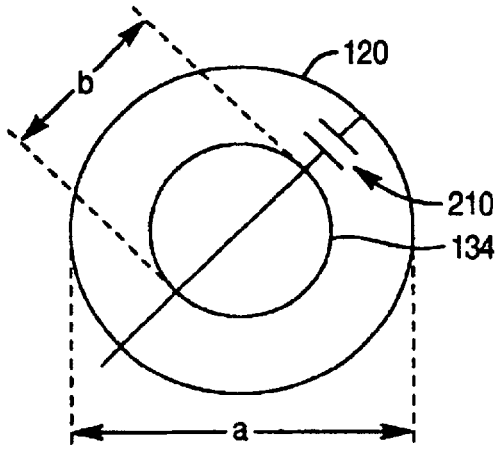
FIG. 5 is a schematic view of the neck portion and cable to illustrate a capacitor formed by the assembly.

FIG. 4 shows a cross-sectional view of the cable 18 and neck portion 120 of the shroud 100. The neck portion 120 forms the outermost layer of the assembly in the cross section shown in FIG. 4. The cable 18 includes the outer insulating jacket 136, the cable shield 134 (e.g., a braid or other type of shield), and inner conductors 138. FIG. 5 shows a schematic representation of the cross-section of FIG. 4, where the neck portion 120 and cable shield 134 form plates of a capacitor 210. The capacitance per length (C/L) of the capacitor 210 between the neck portion 120 and the cable shield 202 is estimated from the equation for calculating the capacitance between two concentric cylinders, as provided below:

$$\frac{C}{L} = \frac{2\pi\varepsilon}{\ln\frac{a}{b}}, \qquad \text{(Eq. 1)}$$

where L is the length of the neck portion 120, the parameter $\epsilon$ represents the permittivity of the dielectric material (the insulating jacket 200) between the two concentric cylinders, "a" represents the inner diameter of the neck portion 120, and "b" represents the outer diameter of the cable shield 202. The reactance $X_c$ of the capacitive connection provided by capacitor 210 is given by Eq. 2:

$$X_c = \frac{1}{2\pi fC}, \qquad \text{(Eq. 2)}$$

where f represents the frequency of signaling communicated in the cable 18.

Thus, in one example, for an assembly where the outer diameter of the cable shield 134 is about 0.171 inches, the inner diameter of the neck portion 120 is about 0.21 inches, and the permittivity of the dielectric material making up the insulating jacket 136 is about 2.25, the capacitance per length (C/L) of the capacitor 210 is approximately 127 picofarads per inch (pF/in.). For cables having larger outer diameters, the overall capacitance increases. Given this example, the capacitive reactance $X_c$ for different frequencies is provided in Table 1, below.

TABLE 1

| Frequency | $X_c$ per inch length (Ohms/inch) | $X_c$ for a 2 inch length (Ohms) | $X_c$ for a 3 inch length (Ohms) |
|---|---|---|---|
| 1 GHz | 1.25 | 0.625 | 0.417 |
| 2 GHz | 0.625 | 0.313 | 0.208 |
| 5 GHz | 0.25 | 0.125 | 0.083 |
| 10 GHz | 0.125 | 0.0625 | 0.0417 |

From Table 1 above, the shroud 100 provides an effective non-contact shield termination at frequencies of greater than about 2 GHz, in one example.

In addition, by providing a continuous capacitive connection of the neck portion 120 around the cable 18, the inductance of the neck 120 can be reduced. The inductance of the neck portion 120 reduces the effectiveness of the neck portion 120 by increasing the total impedance between the chassis panel and the cable shield. By providing the continuous connection around the circumference as shown in FIG. 2, this inductance is reduced.

Figure 6:
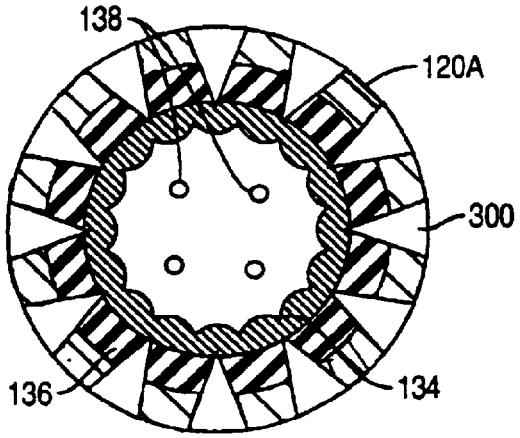
FIGS. 6–7 are cross-sectional views of alternative embodiments of the neck portion and cable.

FIG. 6 shows an alternative embodiment of a shroud 100 that has a neck portion 120A with spikes 300 protruding from the inner surface of the neck portion 120A. The spikes 300 are designed to penetrate the outer insulating jacket 136 to make electrical contact with the cable shield 134. As a result, a direct electrical contact is provided between the cable shield 134 and the neck portion 120, which further decreases the impedance between the shroud 100 and the cable shield 134.

Figure 7:
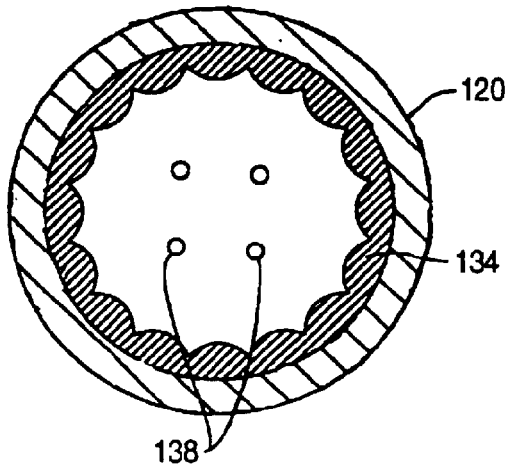

In yet another embodiment, as shown in FIG. 7, the insulating jacket 136 of the cable 18 can be removed so that direct contact can be provided between the neck portion 120 and the cable shield 134.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A shield assembly for a connector that is connected to a port of a chassis, a cable extending from the connector, the shield assembly comprising:

an electrically conductive cover defining a chamber to enclose the connector;

an attachment mechanism adapted to attach the cover to the chassis;

an electrically conductive gasket electrically contacted to the cover and adapted to be placed between the cover and chassis; and a cable engagement body having an opening with a width less than a width of the chamber, the opening adapted to surround an outer surface of a portion of the cable.

2. The shield assembly of claim 1, wherein the cable engagement body comprises a neck portion extending from the cover.

3. The shield assembly of claim 1, wherein the cable engagement body is integrally formed with the cover.

4. The shield assembly of claim 3, wherein the cable engagement body has an outer width that is less than an outer width of the cover.

5. The shield assembly of claim 1, wherein the cable engagement body comprises an inner surface defining the opening, and wherein the width of the opening is substantially the same as a width of the cable to enable the inner surface of the cable engagement body to contact an outer surface of the cable.

6. The shield assembly of claim 5, wherein the cable engagement body is formed at least in part of an electrically conductive material to enable the cable engagement body to be capacitively coupled to a shield of the cable.

7. The shield assembly of claim 6, wherein the electrically conductive cover is adapted to cooperate with the chassis and cable shield to prevent electromagnetic leakage.

8. The shield assembly of claim 1, wherein the cover has an outwardly extending flange, the gasket adapted to be positioned between the flange and the chassis.

9. The shield assembly of claim 1, wherein the cable engagement body has an electrically conductive element adapted to pierce through an outer insulating jacket of the cable to enable electrical connection between the cable engagement body and a shield of the cable.

10. The shield assembly of claim 9, wherein the electrically conductive cover is adapted to cooperate with the chassis and cable shield to prevent electromagnetic leakage.

11. The shield assembly of claim 1, wherein the cover defines the chamber having a space to enclose the connector without contacting a housing of the connector.

12. The shield assembly of claim 1, wherein the cover defines the chamber to enclose the connector that has an electrically conductive housing.

13. A shield assembly for a connector that is connected to a port of a chassis, a cable extending from the connector, the shield assembly comprising:

an electrically conductive cover defining a chamber to enclose the connector;

an attachment mechanism adapted to attach the cover to the chassis; and a cable engagement body having an opening with a width less than a width of the chamber, the opening adapted to surround an outer surface of a portion of the cable, wherein the cable engagement body comprises an inner surface defining the opening, and wherein the width of the opening is substantially the same as a width of the cable to enable the inner surface of the cable engagement body to contact an outer surface of the cable, wherein the cable engagement body comprises an electrically conductive element adapted to pierce through an outer jacket of the cable to enable electrical connection between the cable engagement body and a shield of the cable.

14. The shield assembly of claim 1, wherein the opening has a predetermined length, the opening adapted to surround the outer surface of the portion of the cable along the predetermined length.

15. The shield assembly of claim 1, wherein the opening has a cross-sectional shape selected from the group consisting of generally circular, oval, rectangular, and square.

16. The shield assembly of claim 1, wherein the opening has a cross-sectional shape that forms a closed polygon.

17. A connector assembly for mating with a port in a chassis, comprising:

a connector having a housing formed of an electrically conductive material, the connector adapted to mate with the port;

a cable extending from the connector, the cable having a shield, wherein the connector housing is electrically connected to the shield of the cable;

a shroud adapted to enclose the connector housing, the shroud having an electrically conductive first end to electrically contact the chassis and a cable engagement body having an inner opening to receive the cable, the cable engagement body having an inner surface in contact with an outer surface of the cable, wherein the cable comprises an outer insulating layer, and wherein the inner surface of the cable engagement body is capacitively connected to the cable shield through at least the outer insulating layer, wherein the shroud is formed of an electrically conductive material, and wherein the shroud is adapted to cooperate with the chassis and the cable shield to prevent electromagnetic leakage;

an attachment mechanism adapted to attach the shroud to the chassis; and an electromagnetic interference gasket in contact with a surface of the shroud, the shroud to electrically contact the chassis through the electromagnetic gasket.

18. The connector assembly of claim 17, wherein a capacitive impedance is provided between the cable engagement body and the cable shield in response to transmission of a signal at a predetermined frequency in the cable.

19. A connector assembly for mating with a port in a chassis, comprising:

a connector having a housing formed of an electrically conductive material, the connector adapted to mate with the port;

a cable extending from the connector, the cable having a shield, wherein the connector housing is electrically connected to the shield of the cable;

a shroud adapted to enclose the connector housing, the shroud having an electrically conductive first end to electrically contact the chassis and a cable engagement body having an inner opening to receive the cable, the cable engagement body having an inner surface in contact with an outer surface of the cable, the cable engagement body further having an element to electrically contact the shield of the cable;

an attachment mechanism adapted to attach the shroud to the chassis; and an electromagnetic interference gasket in contact with a surface of the shroud to enhance the electrical contact between the shroud and the chassis.

20. The connector assembly of claim 19, wherein the cable engagement body comprises a neck portion having an outer width that is less than an outer width of another part of the shroud.

21. The connector assembly of claim 19, wherein the shroud defines a chamber in which the connector is located, the width of the inner opening being less than a width of the chamber.

22. The connector assembly of claim 19, wherein the cable engagement body has a predetermined length, the cable engagement body surrounding a portion of the cable along the predetermined length.

23. The connector assembly of claim 19, wherein the cable has an outer insulating jacket, and the cable engagement body has at least one piercing element protruding from the inner surface of the cable engagement body, the piercing element adapted to penetrate the outer jacket of the cable to electrically contact the cable shield.

24. The connector assembly of claim 19, wherein the connector comprises one or more contacts contained in the connector housing.

25. The connector assembly of claim 19, wherein the element to electrically contact the shield of the cable comprises a piercing element.

26. The connector assembly of claim 19, wherein the element to electrically contact the shield of the cable comprises plural piercing elements.

27. The connector assembly of claim 19, wherein the element to electrically contact the shield of the cable comprises an electrically conductive inner surface of the cable engagement body.

28. The connector assembly of claim 19, wherein the shroud is adapted to cooperate with the chassis and cable shield to prevent electromagnetic leakage.

29. A method of reducing electromagnetic interference, comprising:

mating a connector having a housing to port in a chassis;

electrically contacting the connector housing to a shield of a cable;

enclosing the connector within an electrically conductive shroud; and contacting an inner surface of a portion of the shroud to an outer surface of the cable extending from the connector;

electrically connecting the portion of the shroud to the cable shield, wherein the shroud cooperates with the cable shield to prevent electromagnetic leakage;

attaching the shroud to the chassis with an attachment mechanism; and electrically contacting the shroud to the chassis with an electromagnetic interference gasket.

30. The method of claim 29, wherein electrically connecting the portion of the shroud to the cable penetrating, with a piercing element, an outer jacket of the cable, the piercing element being electrically conductive to electrically connect the shroud portion and the cable shield.

31. The method of claim 29, further comprising removing at least a portion of an outer jacket of the cable to enable the shroud portion to contact the cable shield.

32. A system comprising:

a chassis having a structure defining a port;

a connector adapted to mate with the port;

a cable extending from the connector, the cable having a shield, the connector having a housing electrically connected to the shield;

an electrically conductive shroud enclosing the connector, the shroud electrically connected to the shield of the cable;

an attachment mechanism adapted to attach the shroud to the chassis; and an electromagnetic interference gasket to enable electrical contact between the shroud and the chassis.

33. The system of claim 32, wherein the shroud has a portion defining a bore surrounding an outer surface of the cable.

34. The system of claim 33, wherein the shroud portion comprises a neck portion.

35. The system of claim 32, wherein the shroud cooperates with the chassis and cable shield to prevent electromagnetic leakage.

* * * * *

UNITED STATES PATENT AND TRADEMARK OFFICE

CERTIFICATE OF CORRECTION

PATENT NO. : 6,887,105 B2
DATED : May 3, 2005
INVENTOR(S) : Knighten, J. L. and Alexander, R.

It is certified that error appears in the above-identified patent and that said Letters Patent is hereby corrected as shown below:

Column 9,
Line 31, after "cable" insert -- shield comprises --.

Signed and Sealed this

Fourteenth Day of March, 2006

JON W. DUDAS
*Director of the United States Patent and Trademark Office*